US011318531B2

(12) United States Patent
Loewenstein et al.

(10) Patent No.: US 11,318,531 B2
(45) Date of Patent: May 3, 2022

(54) GATE VALVE SYSTEM, CASTING PLANT, AND CASTING PROCESS

(71) Applicants: KSM Castings Group GmbH, Hildesheim (DE); M & A Automation GmbH, Oyten (DE)

(72) Inventors: Joerg Loewenstein, Bremen (DE); Thomas Buschjohann, Nordstemmen (DE); Klaus Greven, Hildesheim (DE)

(73) Assignees: KSM Castings Group GmbH, Hildesheim (DE); M & A Automation GmbH, Oyten (DE)

( * ) Notice: Subject to any disclaimer, the term of this patent is extended or adjusted under 35 U.S.C. 154(b) by 212 days.

(21) Appl. No.: 16/605,083

(22) PCT Filed: Apr. 11, 2018

(86) PCT No.: PCT/DE2018/100335
§ 371 (c)(1),
(2) Date: Oct. 14, 2019

(87) PCT Pub. No.: WO2018/192619
PCT Pub. Date: Oct. 25, 2018

(65) Prior Publication Data

US 2021/0101207 A1 Apr. 8, 2021

(30) Foreign Application Priority Data

Apr. 20, 2017 (DE) ..... 10 2017 108 457.6
Jun. 9, 2017 (DE) ..... 10 2017 112 760.7

(51) Int. Cl.
*B22D 41/42* (2006.01)
*B22D 18/04* (2006.01)
(Continued)

(52) U.S. Cl.
CPC ..... *B22D 41/24* (2013.01); *B22D 17/2015* (2013.01); *B22D 18/04* (2013.01); *B22D 27/09* (2013.01); *B22D 41/42* (2013.01)

(58) Field of Classification Search
CPC ..... B22D 18/04; B22D 27/09; B22D 41/22; B22D 41/24; B22D 41/42; B22D 17/2015
See application file for complete search history.

(56) References Cited

U.S. PATENT DOCUMENTS 3,352,465 A * 11/1967 Shapland ..... B22D 41/24 222/600
4,582,232 A 4/1986 Shapland et al.
(Continued)

FOREIGN PATENT DOCUMENTS

DE 3404836 A1 * 8/1984 ..... B22D 41/42
DE 10 2004 016574 A1 10/2005
(Continued)

OTHER PUBLICATIONS

English translation of the International Preliminary Report on Patentability and Written Opinion of the International Searching Authority in PCT/DE2018/100335, dated Oct. 31, 2019.
(Continued)

*Primary Examiner* — Kevin E Yoon
(74) *Attorney, Agent, or Firm* — Collard & Roe, P.C.

(57) ABSTRACT

A gate valve system includes a base plate and a gate valve plate, a casting plant includes the gate valve system, and a casting process manufactures workpieces, particularly from metal materials. The base plate has an opening and the gate valve plate has a first opening and at least a second opening. The separating gate valve system is set up so that the separating gate valve system can be brought into casting, pressing, and closure positions. In the casting position, the first opening is arranged to align with the opening of the base plate, at least to the greatest possible extent; in the pressing
(Continued)

Figure 1:
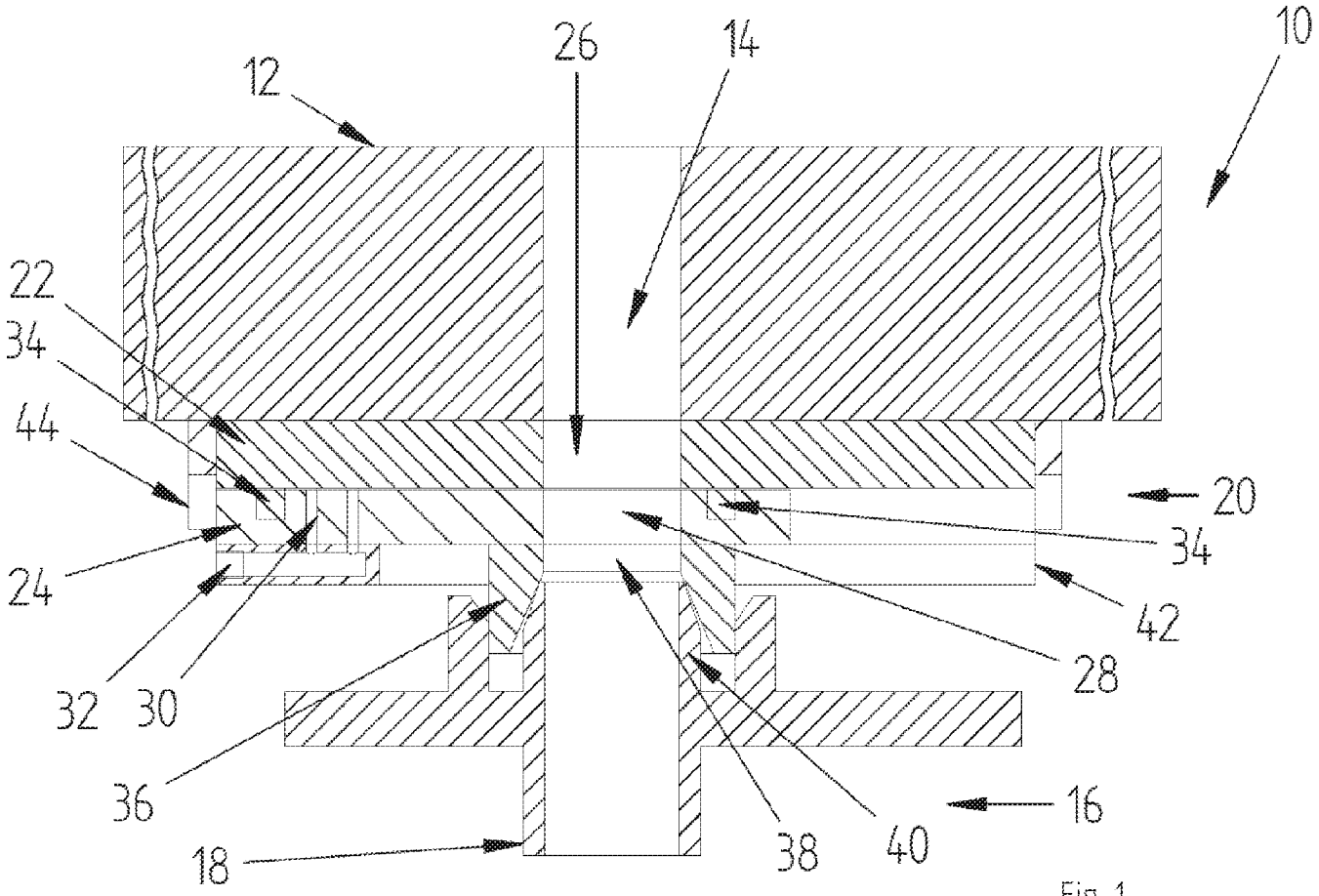

position, the second opening is arranged to align with the opening of the base plate, at least to the greatest possible extent; and in the closure position, the gate valve plate closes off the opening of the base plate.

14 Claims, 3 Drawing Sheets

(51) Int. Cl.

| | |
|---|---|
| ***B22D 27/09*** | (2006.01) |
| ***B22D 41/24*** | (2006.01) |
| ***B22D 17/20*** | (2006.01) |

(56) References Cited

U.S. PATENT DOCUMENTS

| | | | | | |
|---|---|---|---|---|---|
| 4,641,768 | A * | 2/1987 | Hill | ..... | B22D 41/42 222/590 |
| 5,119,976 | A * | 6/1992 | Muller | ..... | B22D 41/42 222/590 |

FOREIGN PATENT DOCUMENTS

| | | | | | |
|---|---|---|---|---|---|
| DE | 10 2012 101 055 | A1 | 8/2012 | | |
| DE | 102014114301 | A1 * | 4/2016 | ..... | B22D 41/465 |
| FR | 2 565 859 | A1 | 12/1985 | | |
| GB | 2 028 478 | A | 3/1980 | | |
| JP | H04-75766 | A | 3/1992 | | |

OTHER PUBLICATIONS

International Search Report in PCT/DE2018/100335, dated Jun. 19, 2018.

* cited by examiner

GATE VALVE SYSTEM, CASTING PLANT, AND CASTING PROCESS

CROSS REFERENCE TO RELATED APPLICATIONS

This application is the National Stage of PCT/DE2018/100335 filed on Apr. 11, 2018, which claims priority under 35 U.S.C. § 119 of German Application Nos. 10 2017 108 457.6 filed on Apr. 20, 2017 and 10 2017 112 760.7 filed on Jun. 9, 2017, the disclosures of which are incorporated by reference. The international application under PCT article 21(2) was not published in English.

The invention relates to a separating gate valve system for a casting facility, to a casting facility, as well as to a casting method for the production of workpieces, in particular composed of metallic materials.

A casting facility and a casting method are known from DE 10 2012 101 055 A1, in which multiple casting units are arranged on a rotary table, these casting units are moved to a casting station and away from it again by means of the rotary table, one after the other, and melt is introduced into the molds of the casting units in the casting station, by means of a low-pressure and/or counter-pressure casting process.

It was the task of DE 10 2012 101 055 A1 to combine the advantages of cycled further transport and the accompanying time saving with the advantage of sufficient casting quality of the cast piece, which can particularly be implemented in a low-pressure and/or counter-pressure casting method.

It is a disadvantage of the method described in DE 10 2012 101 055 A1 that the furnace must remain coupled with the mold and the casting pressure must be maintained until sufficient cooling of the melt has taken place. Depending on the cast piece, this can lead to standing times of the casting facility of several minutes, in which no further cast piece can be cast.

Proceeding from this state of the art, it is the task of the present invention to make available a casting facility and a casting method for the production of cast pieces, which makes it possible to reduce the standing time of the casting facility between the production of two cast pieces in a die-casting method, and thereby to increase the cycle frequency and the economic efficiency of the casting facility.

This task is accomplished by means of a separating gate valve and a casting facility as well as by means of a casting method disclosed herein. Further developments and advantageous embodiments are also disclosed.

The separating gate valve system according to the invention, for a casting facility, in particular for a die-casting facility or a gravity casting facility, comprises a base plate and a gate valve plate, wherein the base plate has an opening and the gate valve plate has a first opening and at least a second opening, and the separating gate valve system is set up in such a manner that the separating gate valve system can be brought into a casting position, a pressing position, and a closure position, wherein in the casting position, the first opening of the gate valve plate is arranged to align with the opening of the base plate, at least to the greatest possible extent; in the pressing position, the second opening of the gate valve plate is arranged to align with the opening of the base plate, at least to the greatest possible extent; and in the closure position, the gate valve plate closes off the opening of the base plate.

Such a separating gate valve system makes it possible to open and/or close off a passage opening between a mold and a furnace. Furthermore, the separating gate valve system according to the invention is able to separate the mold from the furnace after introduction of the melt into the mold, and, at the same time, to build up a pressure on the melt and/or to maintain the casting pressure within the mold. This is achieved in that the separating gate valve system is brought from a casting position into a pressing position.

It can be advantageous if a funnel plate is disposed on the gate valve plate.

A funnel plate serves for easier coupling between a sprue region of the mold and a connector and/or a riser pipe of a furnace. Preferably, in this regard, the funnel plate is configured as a holder of the connector or of the riser pipe of the furnace. In order to simplify holding and consequently coupling between mold and furnace, it is advantageous if the funnel plate has inside surfaces that are slanted, at least in part, and the connector has outside surfaces that are slanted complementary to these slanted inside surfaces.

It can be advantageous if the separating gate valve system consists, at least in part, of tungsten and/or a tungsten alloy and/or a ceramic material.

Tungsten possesses a very high melting point and is therefore suitable for the construction of components for use in a casting facility, in which metallic materials are processed.

Furthermore, tungsten does not have an adhesive effect on aluminum and is therefore suitable for use in a casting facility and/or a separating gate valve system in which a melt composed of aluminum or an aluminum alloy is processed.

It can be advantageous if the distance between base plate and gate valve plate amounts to less than 0.15 mm. In order to minimize seepage of the liquid metallic material, in particular aluminum, into the interstice between base plate and gate valve plate, it is advantageous to configure the distance between base plate and gate valve plate to be as small as possible, in particular <0.15 mm.

It can be advantageous if the first opening has a larger cross-sectional surface area through which flow can take place than the second opening.

The casting facility according to the invention, in particular the die-casting facility or gravity casting facility according to the invention, comprises a mold and a furnace, wherein a separating gate valve system is disposed between the mold and the furnace.

Casting facilities for use in a die-casting method, during the course of which the mold is separated from the furnace, are known, for example, from DE 10 2012 101 055 A1. Before uncoupling between the mold and the furnace can take place in the casting facilities known in the state of the art, however, the molds must remain coupled with the furnace until sufficient cooling of the melt in the mold has taken place, so as to prevent melt in the mold that has not yet solidified from flowing out. Until sufficient solidification has taken place, several minutes might have elapsed, depending on the cast piece. During this time, no further cast piece can be cast by means of the furnace.

The placement of the separating gate valve system according to the invention between the mold and the furnace makes it possible to close off a passage opening between the mold and the furnace, by way of which the melt is introduced into the mold from the furnace, after the melt has been introduced into the mold. The separating gate valve system is brought either into a closure position or into a pressing position.

After the separating gate valve system has been brought from a casting position into a pressing position or a closure position, by way of a pressing apparatus, in particular by way of a mechanical and/or pneumatic pressing apparatus, the casting pressure generated by the furnace is no longer maintained by way of the furnace.

In a pressing position of the separating gate valve system, the casting pressure generated by the furnace can be maintained by means of a pressing apparatus, in particular a pneumatic pressing apparatus. For this purpose, a gas pressure is generated by the pneumatic pressing apparatus, which pressure acts on the melt, in particular on the melt in the sprue channel and/or the feeder, and thereby increases the pressure on the melt.

In a closure position of the separating gate valve system, the casting pressure generated by the furnace can be maintained within the mold by means of a pressing apparatus, in particular a mechanical pressing apparatus. For this purpose, a mechanical gate valve is moved into a feeder of the mold and thereby increases the pressure on the melt.

It is also possible to introduce the melt into the mold without additional pressure, for example in a gravity casting method, and to build up and exert a pressure on the melt that is greater than the ambient pressure, in particular greater than the average atmospheric pressure (1013 hPa), only after the melt has been brought into the mold and after displacement of the separating gate valve system from a casting position into a pressing position.

Consequently, it is possible to uncouple the furnace from the mold directly after introduction of the melt into the mold. After the mold has been moved from the casting station to a cooling station, the furnace is available for a further casting process. Thereby the disadvantageous standing time of the casting facility described in the state of the art is shortened by up to several minutes, and consequently the cycle frequency for casting of individual cast pieces is increased.

It can be advantageous if the separating gate valve system is set up in such a manner that the separating gate valve system can be brought into the casting position, the pressing position and/or the closure position by means of a relative movement of the mold relative to the furnace, which is fixed in place.

By means of bringing the separating gate valve system into the different positions by means of a relative movement of the mold relative to the furnace, which is fixed in place, it is made possible to operate the separating gate valve system without the use of an additional drive.

Bringing the separating gate valve into the different positions in this way is particularly suitable for use in a casting facility that uses a rotary table for transport of the molds. After the melt has been introduced into the mold, bringing the separating gate valve from the casting position into the pressing position or closure position takes place automatically by means of the rotational movement of the rotary table that moves the mold from a casting station to a cooling station. Furthermore, bringing the separating gate valve into the different positions in this way is particularly suitable for use in a casting facility that uses a robot arm for transport of the molds. After the melt has been introduced into the mold, the separating gate valve is automatically brought from the casting position into the pressing position or closure position by means of a rotational movement or a linear movement of the robot arm.

It can be advantageous if, in the casting position, the first opening of the gate valve plate, the opening of the base plate, a sprue region of the mold, and a connector of the furnace are arranged relative to one another in such a manner that a passage opening is formed, through which a melt can be introduced into the mold from the furnace.

It can be advantageous if the sprue region of the mold is completely closed off by the gate valve plate of the separating gate valve system in the closure position.

After the melt has cooled off sufficiently, the casting pressure no longer needs to be maintained. In order to prevent penetration of foreign bodies into one of the openings of the gate valve plate, which could have a negative influence on a subsequent casting process, it is advantageous to bring the separating gate valve system from the pressing position into a closure position as soon as possible, i.e. after the melt has solidified sufficiently and the casting pressure no longer needs to be maintained, in which closure position the openings of the gate valve plate are covered by the base plate.

It can be advantageous if the base plate is integrated into the mold.

Integration of the base plate into the mold makes it possible to arrange the gate valve plate directly on the outer region of the mold. Thereby it is possible to save a component and consequently to save costs.

It can be advantageous if the sprue region has a sprue channel and/or a feeder.

It can be advantageous if the sprue region or the mold is set up in such a manner that a pressing apparatus, in particular a mechanical and/or pneumatic pressing apparatus can apply a pressure to the melt in the sprue region, in particular in the sprue channel and/or the feeder, and thereby the casting pressure can be maintained within the mold even after it is uncoupled from separating gate valve system and furnace.

In order to maintain the casting pressure after introduction of the melt into the mold, pressure is exerted on the melt by means of a pressing apparatus. This can take place either on the melt in the sprue channel or an additional feeder can be provided in the mold, on the content of which feeder the pressing apparatus exerts the pressure to maintain the casting pressure.

The pressing apparatus can be configured as a mechanical pressing apparatus and/or as a pneumatic pressing apparatus. In the case of a mechanical pressing apparatus, a mechanical gate valve, which is advantageously arranged on the mold, is moved by means of the mold and exerts a pressure on the melt in the mold, in particular on the melt in a feeder.

A pneumatic pressing apparatus generates a gas pressure that acts on the melt in the mold, in particular on the melt in the sprue channel and/or the feeder. A combination of the mechanical and the pneumatic apparatuses is also conceivable.

It can be advantageous if the casting facility comprises a transport apparatus that transports the mold from a casting station to a cooling station.

After the melt has been introduced into the mold and the separating gate valve system has been brought from a casting position into a pressing position or closure position, the filled mold must be removed from the casting station so as to make the casting station available for a further casting process. This is achieved in that the filled mold is brought from the casting station to a cooling station by means of a transport apparatus. In this regard, the casting pressure within the mold is maintained by means of a pressing apparatus. This can be done by means of a mechanical pressing apparatus and/or a pneumatic pressing apparatus. In this regard, in the case of a pneumatic pressing apparatus, the casting pressure is maintained even during the transport process, by means of supply lines.

It can be advantageous if the transport apparatus comprises a rotary table and/or a robot arm.

A rotary table has the advantage that even large and heavy cast parts can be produced by means of corresponding dimensioning. A robot arm, in contrast, can be used in very flexible manner and can rotate the mold during transport or expose it to other forms of movement.

It can be advantageous if the furnace, in particular the connector of the riser pipe of the furnace, has an end that comes to a point, i.e. that in particular, the wall thickness of the connector of the riser pipe narrows toward the end that is coupled with the funnel plate of the separating gate valve system.

The casting method according to the invention, in particular die-casting method or gravity casting method, for the production of cast pieces, in particular composed of metallic materials, comprises the method steps:

- bringing a separating gate valve system into a casting position,
- coupling the separating gate valve system and the furnace,
- introducing a melt into a mold,
- bringing the separating gate valve system into a pressing position or a closure position,
- uncoupling the separating gate valve system and the furnace,
- bringing the separating gate valve system into a closure position.

Wherein in particular, the method steps 1 and 2 can take place in any desired sequence. The last method step is optional and not compulsorily required.

Use of a separating gate valve system according to the invention will be described in the following for use in a low-pressure or counter-pressure casting method, in which the casting pressure is maintained after introduction of the melt, directly, by means of a pressing apparatus, in particular a pneumatic pressing apparatus. However, use of the separating gate valve system is not restricted to these die-casting methods. The separating gate valve system according to the invention can also be used in a casting method, in particular in a gravity casting method, in which a pressure is built up and exerted on the melt only after introduction of the melt into a mold.

The starting point of the casting method according to the invention is a furnace filled with melt and a mold spatially separated from the furnace. The mold is located spatially above the furnace and has a separating gate valve system according to the invention on the underside.

The mold, prepared for a casting process, is brought into a casting station by means of a transport apparatus. In the casting station, the furnace and/or the mold is/are moved relative to one another, in particular toward one another, and the furnace is coupled with the separating gate valve system of the mold.

If the separating gate valve system is not in a casting position, the separating gate valve system is brought into a casting position in that the mold and/or the furnace perform (s) a movement, in particular a lateral movement.

After the casting facility is in a casting position, in which at least the opening of the base plate, the first opening of the gate valve plate, and the opening of the funnel plate form a continuous passage opening from furnace to mold, the melt is introduced into the mold. For this purpose, a casting pressure is exerted on the surface of the melt in the furnace, and the melt rises through the riser pipe, through the first opening of the gate valve plate, through the opening of the base plate, and through the sprue region into the casting mold.

After the melt has been completely introduced into the mold, the separating gate valve system is brought into a pressing position. Bringing the separating gate valve system into a pressure position preferably takes place automatically with the transport of the mold from the casting station to a cooling station. Due to the relative movement of the mold relative to the furnace or vice versa, the separating gate valve system, in particular the gate valve plate is moved, in particular moved laterally.

At the end of the movement, the opening of the base plate is no longer brought into coverage with the first opening of the gate valve plate, at least in part, but rather is brought into coverage with the second opening of the gate valve part, at least in part.

While the separating gate valve system is being brought from the casting position into the pressing position, a pressure is applied to the second opening of the gate valve plate by means of a pressing apparatus, in particular pneumatic pressing apparatus, which pressure corresponds, at least to a great extent, to the casting pressure of the casting facility.

After the casting pressure is maintained, at least to the greatest possible extent, within the mold by means of the pressing apparatus, in particular by means of the pneumatic pressing apparatus, the furnace is uncoupled from the separating gate valve system and the mold is brought further into the cooling station.

In order to prevent penetration of foreign bodies into the mold, the separating gate valve system can be brought into a closure position after sufficient cooling of the melt in the mold, in which position the sprue region of the mold is completely closed off by the gate valve plate, and the openings of the gate valve plate are closed off by means of the base plate, at least on one side.

In order to couple the furnace with the separating gate valve system, an end region of the riser pipe of the furnace, in particular, or a connector of the furnace is brought into mechanical contact with the gate valve plate, in particular a funnel plate disposed on the gate valve plate of the separating gate valve system. Either the end region of the riser pipe or the connector is introduced into the funnel plate or set over the funnel plate.

An alternative method provides that after the melt has been completely introduced into the mold, the separating gate valve system is brought into a closure position. Bringing the separating gate valve system into a closure position preferably takes place automatically with the transport of the mold from the casting station into a cooling station. Due to the relative movement of the mold relative to the furnace or vice versa, the separating gate valve system, in particular the gate valve plate, is moved, in particular moved laterally.

At the end of the movement, the opening of the base plate is no longer brought into coverage with the first opening of the gate valve plate, at least in part, but rather is completely closed off by means of the gate valve plate.

While the separating gate valve system is brought from the casting position into the closure position, pressure is exerted on the melt in the mold by means of a pressing apparatus, in particular a mechanical pressing apparatus, which pressure corresponds to the casting pressure of the casting facility, at least to the greatest possible extent.

After the casting pressure within the mold is maintained, at least to the greatest possible extent, by means of the pressing apparatus, in particular by means of the mechanical pressing apparatus, the furnace is uncoupled from the separating gate valve system and the mold is rotated by 180°.

Subsequent to the rotation, the separating gate valve system can be brought from the closure position into the pressing position. In the pressing position, the opening of the base plate is brought into coverage with the second opening of the gate valve plate, at least in part.

While the separating gate valve system is being brought from the closure position into the pressing position, pressure is applied to the second opening of the gate valve plate by means of a pressing apparatus, in particular a pneumatic pressing apparatus, which pressure corresponds, at least to the greatest possible extent, to the casting pressure of the casting facility.

After the casting pressure within the mold has been maintained, at least to the greatest possible extent, by means of the pressing apparatus, in particular by means of the pneumatic pressing apparatus, the mold can be brought further into the cooling station.

It can be advantageous if the mold is rotated about at least one axis after uncoupling from separating gate valve system and furnace.

The rotation of the mold preferably encloses an angle between 1° and 180°, in particular 180°.

It can be advantageous if the mold is rotated by means of a tilt casting machine or a robot.

It can be advantageous if the separating gate valve system is brought into a pressing position after rotation of the mold about at least one axis.

It can be advantageous if the separating gate valve system is brought into a closure position after rotation of the mold about at least one axis and after the separating gate valve system has been brought into a pressing position.

It can be advantageous if the casting pressure within the mold is maintained by means of a pressing apparatus, in particular by means of a pneumatic and/or mechanical pressing apparatus, in the pressing position and/or the closure position.

In order to separate the furnace from the mold as quickly as possible after the melt has been completely introduced into the mold, but simultaneously to maintain the casting pressure within the mold as long as possible, the casting pressure within the mold is maintained by means of an external pressing apparatus, in particular by means of a pneumatic and/or mechanical pressing apparatus.

It can be advantageous if the casting pressure on the melt is maintained in the pressing position by means of a gas pressure, in particular by means of air pressure.

It is easy to build up, regulate, and maintain a gas pressure. It is advantageous if gases that do not react or react only slightly with the casting material are used. In this way, a negative influence on the cast piece is prevented.

It can be advantageous if the separating gate valve system is brought into the casting position, the pressing position and/or the closure position by means of a relative movement of the mold relative to the furnace.

Bringing the separating gate valve system into the casting position, the pressing position and/or the closure position by means of a relative movement of the mold relative to the furnace or vice versa has the advantage that no further drive is required for activation of the separating gate valve system.

It can be advantageous if the mold is rotated about at least one axis and subsequently the casting pressure within the mold is maintained by means of a pressing apparatus, in particular a pneumatic pressing apparatus.

Further developments and advantageous embodiments of the invention can become evident from the following descriptions of exemplary embodiments, which are shown in the drawing. Characteristics that are essential to the invention can also become evident from the placement of individual components, openings, recesses, blank areas and/or depressions relative to one another. If the same reference symbols are used in the figures, these refer to the same parts.

Figure 2:
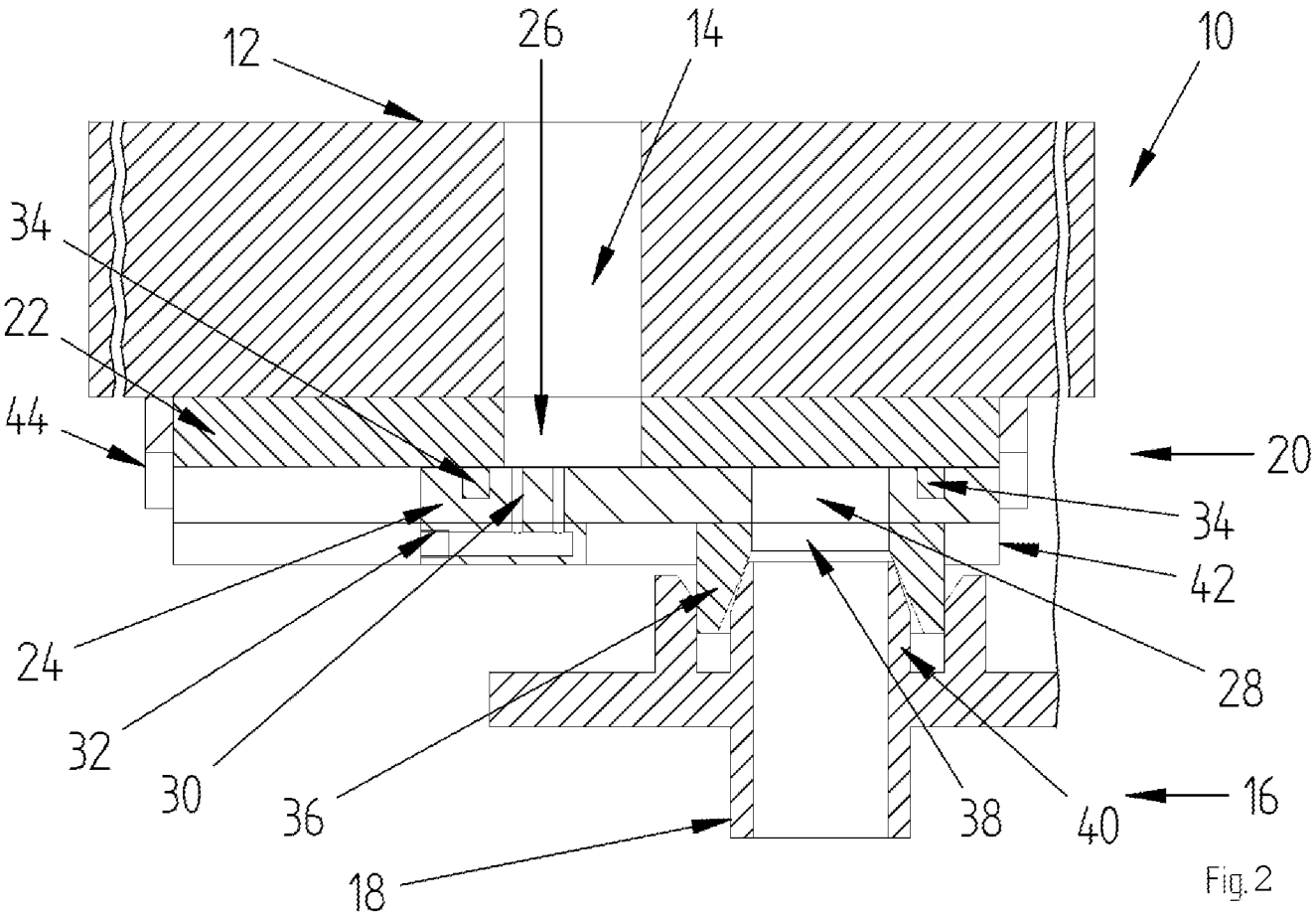
Figure 3:
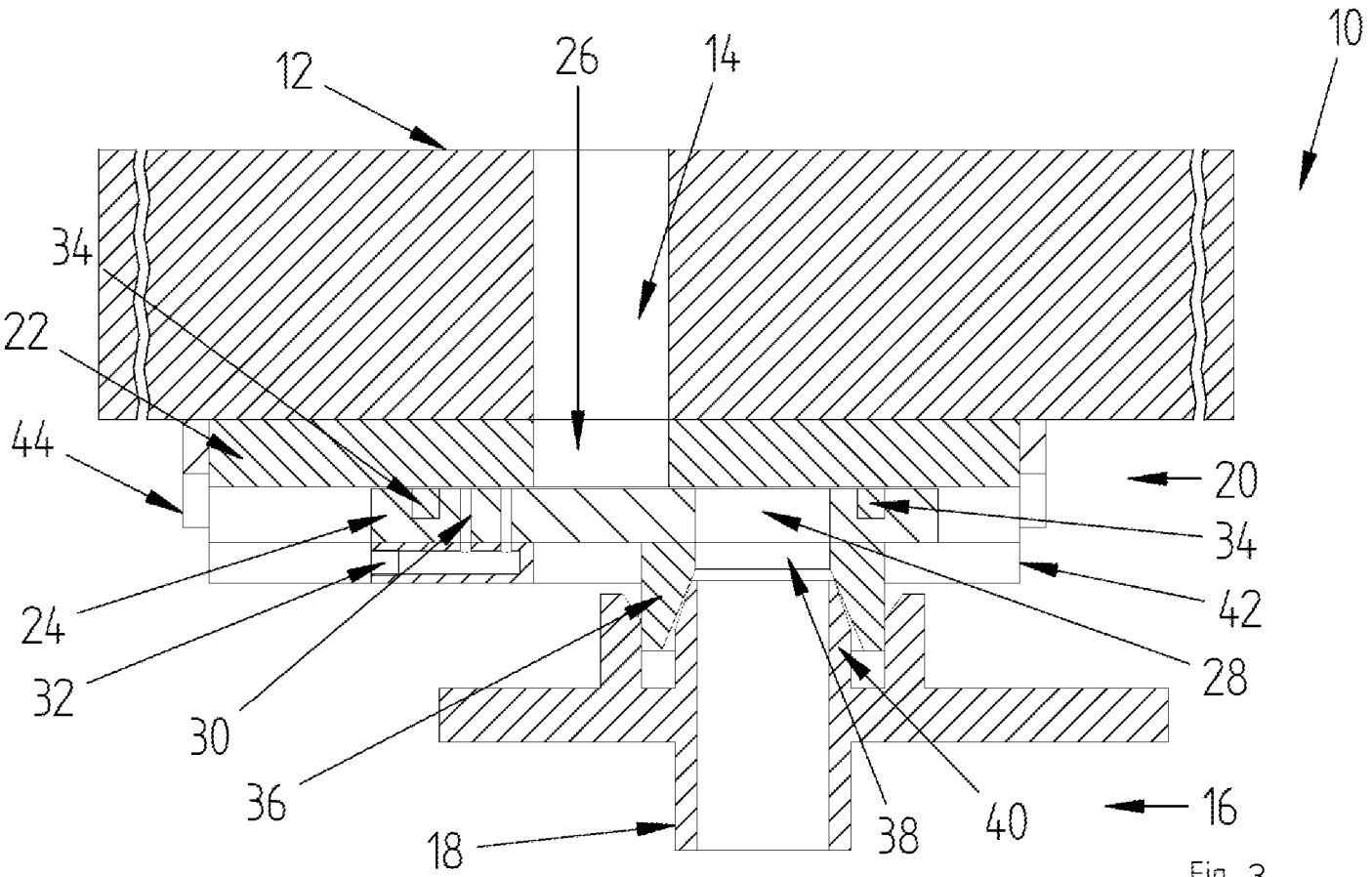

The drawing shows:

FIG. 1 shows a cross-section of a partial region of a casting facility according to the invention, having a separating gate valve system in the casting position, FIG. 2 shows a cross-section of a partial region of a casting facility according to the invention, having a separating gate valve system in the pressing position, FIG. 3 shows a cross-section of a partial region of a casting facility according to the invention, having a separating gate valve system in the closure position.

FIG. 1 shows a partial region of a casting facility 10 according to the invention in a cross-sectional view. In the upper region of FIG. 1, a partial region of a mold 12 having a sprue region 14 situated in it is shown. In the case of the present embodiment, the sprue region 14 is configured as a sprue channel without a feeder. In the lower region of FIG. 1, a partial region of the furnace 16 having a riser pipe 18 is shown.

A separating gate valve system 20 is arranged between the mold 12 and the furnace 16. In this regard, FIG. 1 shows the separating gate valve system 20 according to the invention in a casting position. The separating gate valve system 20 shown comprises a base plate 22 and a gate valve plate 24. The base plate 22 has an opening 26. The gate valve plate 24 has a first opening 28 as well as a second opening 30. In this regard, the second opening 30 is configured by means of two passage openings 30*a*, 30*b* through the gate valve plate.

Following this second opening 30, the pressing apparatus (not shown) is connected with the second opening 30 by way of a pressure feed line 32. Furthermore, seals 34 are arranged between the base plate 22 and the gate valve plate 24. The seals 34 are recessed into the gate valve plate 24.

Furthermore, the separating gate valve system 20 comprises a funnel plate 36, which is arranged on the gate valve plate 24 and aligned with it. The funnel plate 36 has an opening 38, wherein the opening 38 of the funnel plate 36 is arranged aligned with the first opening 28 of the gate valve plate 24 and forms a common passage opening. The funnel plate 36 has slanted side regions on the side facing the opening 38.

The furnace 16 has a connector 40 at the end of the riser pipe 18, which connector has slanted side regions on its outside. In this regard, the slanted side regions of the connector 40 are slanted in complementary manner to the side regions of the funnel plate 36. When the furnace 16 is coupled with the separating gate valve system 20, the slanted regions of funnel plate 36 and connector 40 slide on one another. Due to the slanted side regions, the coupling process is simplified and slight deviations of separating gate valve system 20 and furnace 16 can be equalized.

The gate valve plate 24 is displaceably mounted by means of lateral guides 42, wherein the base plate 22 has stops 44 in its end regions, which stops delimit the lateral displacement of the gate valve plate 24.

FIG. 1 shows the casting facility, in particular the separating gate valve system 20, in a casting position. In this regard, the furnace 16 is coupled with the funnel plate 36 by way of the connector 40. The furnace 16, the riser pipe 18, the gate valve plate 24, the base plate 22, as well as the sprue region 14 are arranged relative to one another, in the casting position, in such a manner that the opening 26 of the base plate 22, the first opening 28 of the gate valve plate 24, and the opening 38 of the funnel plate 36 form a continuous passage opening from the furnace 16 to the mold 12. The second opening 30 of the gate valve plate 24 is displaced laterally toward the opening 28 of the base plate 22.

FIG. 2 shows the same partial region of a casting facility 10 according to the invention in a cross-sectional view as in FIG. 1. Contrary to FIG. 1, in FIG. 2 the casting facility 10 according to the invention is shown in a pressing position.

In the pressing position, the furnace 16, the gate valve plate 24, the base plate 22, as well as the sprue region 14 are arranged relative to one another in such a manner that the opening 26 of the base plate 22 and the second opening 30 of the gate valve plate 24 form a continuous passage opening from the pressing apparatus (not shown) to the mold 12. The first opening 28 of the gate valve plate 24 is displaced laterally relative to the opening 26 of the base plate 22.

FIG. 3 shows the same partial region of a casting facility 10 according to the invention in a cross-sectional view as in FIGS. 1 and 2. Contrary to FIGS. 1 and 2, in FIG. 3 the casting facility 10 according to the invention is shown in a closure position.

In the closure position, the furnace 16, the gate valve plate 24, the base plate 22, as well as the sprue region 14 are arranged relative to one another in such a manner that neither a passage opening from the furnace 16 to the mold 12 nor from the pressing apparatus (not shown) to the mold 12 is formed. Instead, the gate valve plate 24 completely closes off the opening 26 of the base plate 22. Both the first opening 28 and the second opening 30 of the gate valve plate 24 are displaced laterally relative to the opening 28 of the base plate 22.

REFERENCE SYMBOL LIST (is part of the description)
10 casting facility
12 mold
14 sprue region
16 furnace
18 riser pipe
20 separating gate valve system
22 base plate
24 gate valve plate
26 opening in base plate
28 first opening in gate valve plate
30 second opening in gate valve plate
32 pressure feed line
34 seal
36 funnel plate
38 opening in funnel plate
40 connector
42 lateral guide
44 stop

The invention claimed is:

1. A casting facility comprising a mold and a furnace, wherein a separating gate valve system is arranged between the mold and the furnace, wherein the separating gate valve system comprises a base plate and a gate valve plate, wherein the base plate has an opening and the gate valve plate has a first opening and at least a second opening, and the separating gate valve system is set up in such a manner that the separating gate valve system can be brought into a casting position, a pressing position, and a closure position, wherein in the casting position, the first opening of the gate valve plate is arranged to align with the opening of the base plate, at least to the greatest possible extent; in the pressing position, the second opening of the gate valve plate is arranged to align with the opening of the base plate, at least to the greatest possible extent; and in the closure position, the gate valve plate closes off the opening of the base plate, wherein the second opening of the gate value plate is connected to a pneumatic pressure device, so that in the pressure position a pressure is applied to the second opening of the gate value plate to maintain the casting pressure within the mold.

2. The casting facility according to claim 1, wherein the separating gate valve system is set up in such a manner that the separating gate valve system can be brought into the casting position, the pressing position and/or the closure position by means of a relative movement of the mold relative to the furnace, which is fixed in place.

3. The casting facility according to claim 1, wherein in the casting position, the first opening of the gate valve plate, the opening of the base plate, a sprue region of the mold, and a connector of the furnace are arranged relative to one another in such a manner that a passage opening is formed, through which a melt can be introduced into the mold from the furnace.

4. The casting facility according to claim 1, wherein in the closure position, a sprue region of the mold is completely closed off by the gate valve plate of the separating gate valve system.

5. The casting facility according to claim 4, wherein the sprue region has a sprue channel and/or a feeder.

6. The casting facility according to claim 4, wherein the sprue region or the mold is set up in such a manner that the pneumatic pressure device can apply a pressure to the melt in the sprue region and thereby the casting pressure can be maintained within the mold even after it is uncoupled from separating gate valve system and furnace.

7. The casting facility according to claim 1, wherein the gate valve plate is integrated into the mold.

8. The casting facility according to claim 1, wherein the casting facility comprises a transport apparatus that transports the mold from a casting station to a cooling station.

9. The casting facility according to claim 8, wherein the transport apparatus comprises a rotary table and/or a robot arm.

10. The casting facility according to claim 1, wherein the furnace has an end that comes to a point, which can be coupled with a funnel plate of the separating gate valve system.

11. The casting facility according to claim 1, wherein a funnel plate is arranged on the gate valve plate.

12. The casting facility according to claim 1, wherein the separating gate valve system comprises, at least in part, tungsten and/or a tungsten alloy and/or a ceramic material.

13. The casting facility according to claim 1, wherein a distance between the base plate and the gate valve plate amounts to less than 0.15 mm.

14. The casting facility according to claim 1, wherein the first opening has a larger cross-sectional surface area through which flow can take place than the second opening.

* * * * *